US007096828B2

(12) United States Patent
Tippmann

(10) Patent No.: US 7,096,828 B2
(45) Date of Patent: Aug. 29, 2006

(54) SELF CLEANING BOILER AND STEAM GENERATOR

(75) Inventor: Vincent P. Tippmann, Fort Wayne, IN (US)

(73) Assignee: American Griddle Corporation, Fort Wayne, IN (US)

( * ) Notice: Subject to any disclaimer, the term of this patent is extended or adjusted under 35 U.S.C. 154(b) by 0 days.

(21) Appl. No.: 10/926,999

(22) Filed: Aug. 27, 2004

(65) Prior Publication Data

US 2005/0072382 A1 Apr. 7, 2005

Related U.S. Application Data

(60) Provisional application No. 60/498,647, filed on Aug. 29, 2003.

(51) Int. Cl.
*F22B 37/46* (2006.01)

(52) U.S. Cl. ..... 122/447; 236/20 R; 236/26 R

(58) Field of Classification Search ..... 122/447, 122/446, 14.1; 236/20 R, 21 B, 26 F, 26 R
See application file for complete search history.

(56) References Cited

U.S. PATENT DOCUMENTS 3,670,807 A * 6/1972 Muller ..... 165/299
5,355,840 A * 10/1994 Violi ..... 392/401
6,055,944 A * 5/2000 Santiago ..... 122/14.22
6,059,195 A * 5/2000 Adams et al. ..... 236/20 R

* cited by examiner

*Primary Examiner*—Gregory Wilson
(74) *Attorney, Agent, or Firm*—Birch, Stewart, Kolasch and Birch, LLP

(57) ABSTRACT

A steam generator boiler for generating steam is connected to a supply conduit for supplying water to the boiler with a supply valve for controlling the supply of water through the supply conduit. A heater supplies heat to the boiler for generating steam with a discharge conduit for discharging excess impure water therefrom. A metering device is operatively connected to the supply conduit for regulating the flow of water to the boiler by calculating the amount of water required based on wattage or BTU's generated by the heater. A pressure switch or thermostat is provided for operating the boiler and the supply valve on the supply conduit for supplying water to the boiler to permit water to be added every time the heater is energized. In addition, a heat exchanger is provided for receiving discharged heated water from the steam generator and preheating water supplied to the steam generator.

17 Claims, 2 Drawing Sheets

SELF CLEANING BOILER AND STEAM GENERATOR

CROSS-REFERENCE TO RELATED APPLICATIONS

The present application is related to U.S. Provisional Application No. 60/498,647 filed on Aug. 29, 2003 the entire contents of which are hereby incorporated by reference and the priority is claimed under 35 USC 119(e).

BACKGROUND OF THE INVENTION

1. Field of the Invention

The purpose of this invention is to have a boilers or steam generator that is self cleaning, requires no floats or level controls and reclaims heat that would normal be dissipated into the air or down the drain.

2. Description of Background Art

Hithertofore, steam generator boilers were available that operate by supplying a quantity of water to a steam generator boiler for producing steam. However, the supply of water and the discharge of the waste water was not controlled to optimize the supply of water and to maximize the use of the heat from the discharged water for preheating the supply water.

SUMMARY AND OBJECTS OF THE INVENTION

It is an object of the present invention to provide a steam generator boiler that optimizes the supply of water and maximizes the use of heat from the discharged water for preheating the supply water.

This and other objects of the present invention are achieved by providing a steam generator boiler for generating steam that is connected to a supply conduit for supplying water to the boiler with a supply valve for controlling the supply of water through the supply conduit. A heater supplies heat to the boiler for generating steam with a discharge conduit for discharging excess impure water therefrom. A metering device is operatively connected to the supply conduit for regulating the flow of water to the boiler by calculating the amount of water required based on wattage or BTU's generated by the heater. A pressure switch or thermostat is provided for operating the boiler and the supply valve on the supply conduit for supplying water to the boiler to permit water to be added every time the heater is energized. In addition, a heat exchanger is provided for receiving discharged heated water from the steam generator and preheating water supplied to the steam generator.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
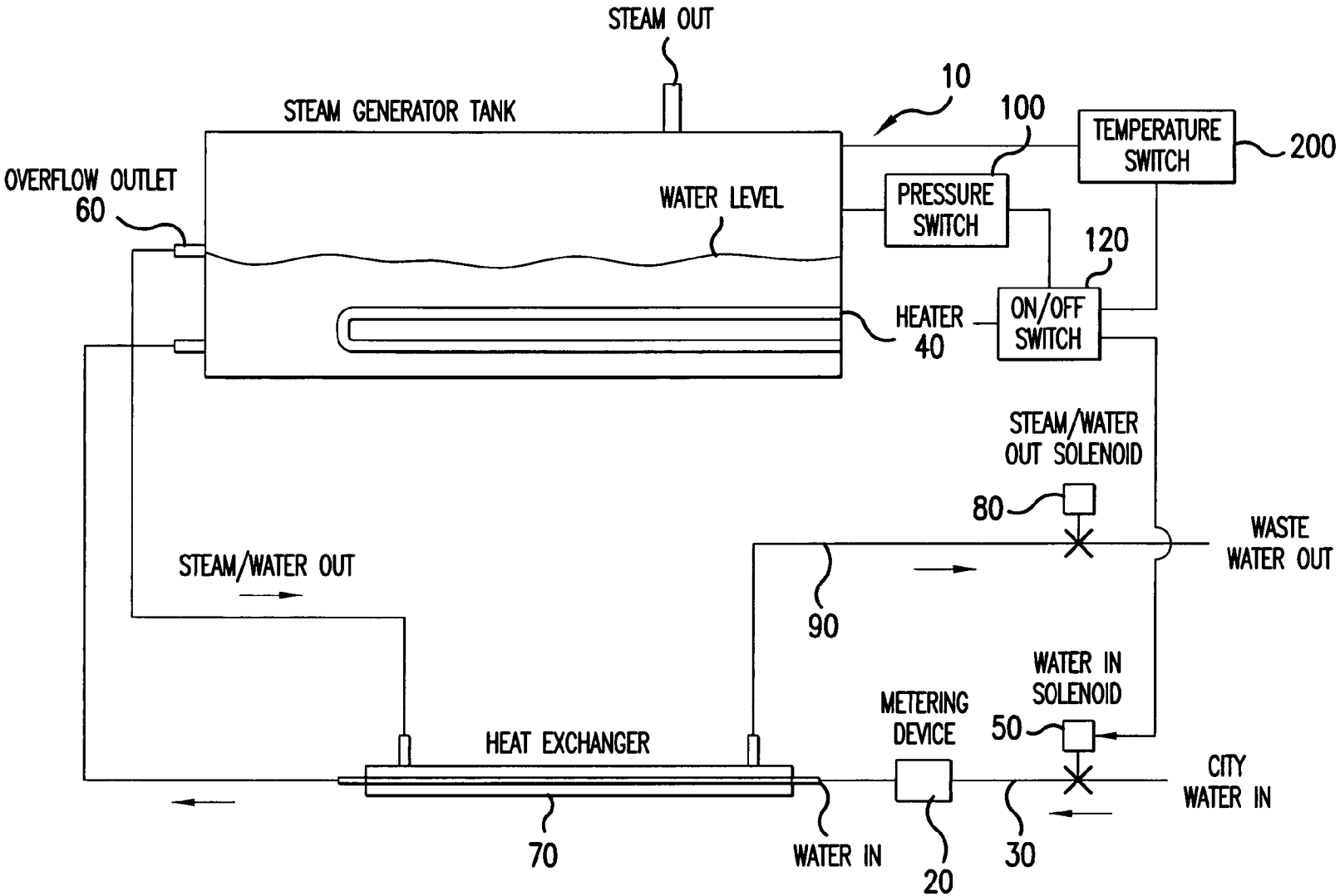
FIG. 1 is a schematic view illustrating the flow of water to the steam generator and the use of the overflow water flowing from the steam generator through the heat exchanger for preheating the intake water.
Figure 2:
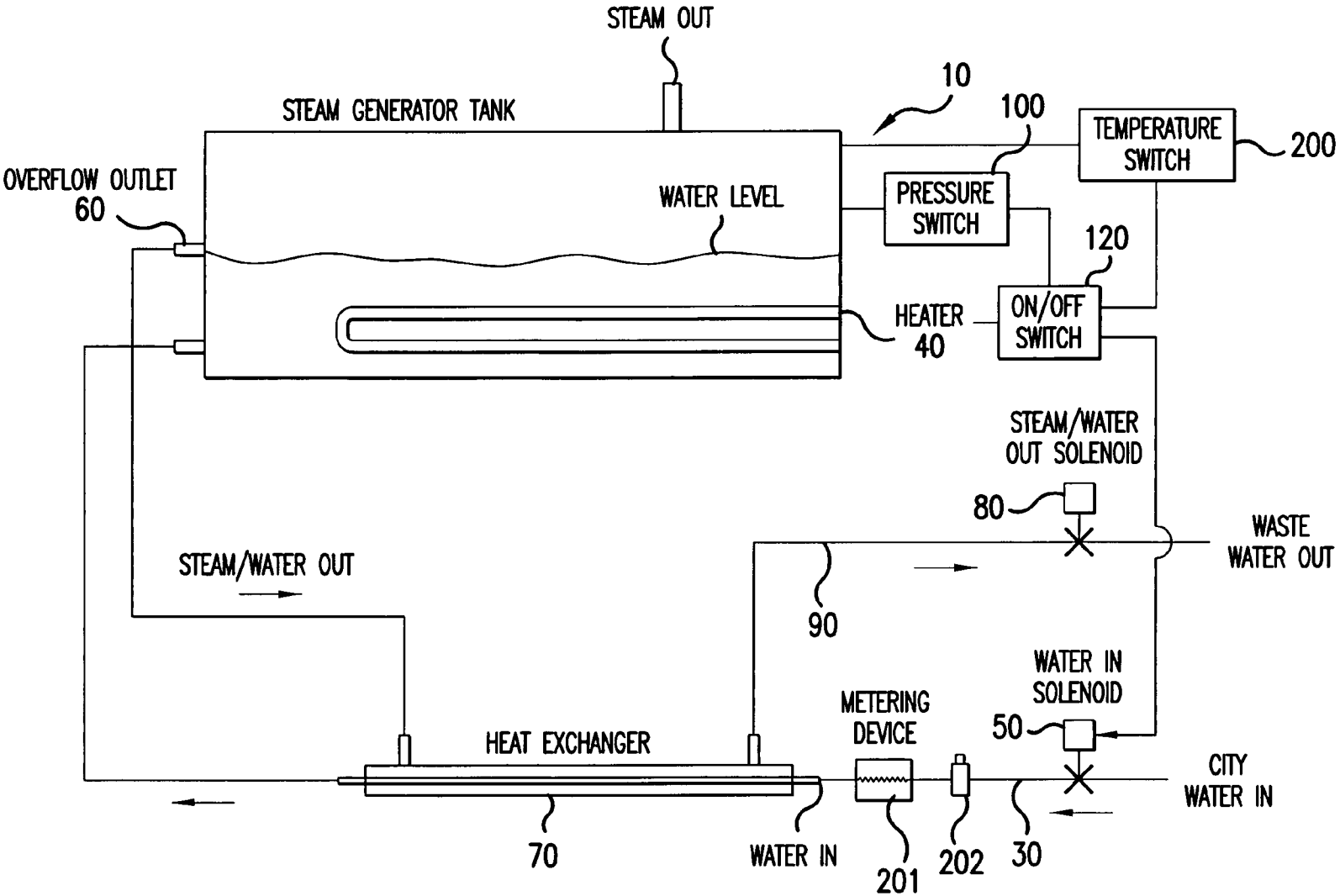
FIG. 2 is a schematic view illustrating the flow of water to the steam generator by use of a capillary tube and a pressure regulator.

As illustrated in FIGS. 1 and 2, a steam generator boiler 10 operates by utilizing a metering device 20 in the inlet 30 of the boiler or steam generator 10 to regulate the flow of water to the boiler 10 by calculating the amount of water required based on wattage or BTU's generated by the heaters 40. The boiler or steam generator heaters 40 would be operated by a pressure switch or thermostat, not shown, which would also operate the solenoid valve 50 on the inlet side 30 for the supply of water to the steam generator tank. Thus, water is added every time the heaters 40 are energized.

A pressure switch 100 would include a pressure sensor located within the boiler or steam generator 10 for determining the pressure inside the boiler or steam generator 10. When the pressure within the boiler or steam generator 10 rises above a predetermined pressure, the pressure within the boiler or steam generator 10 would actuate the on/off switch 120 and turn off the heaters 40 and turn off the solenoid 50. If the pressure within the boiler or steam generator 10 is below the predetermined pressure, the pressure switch 100 would actuate the on/off switch 120 and turn on the heaters 40 and the solenoid 50 would be actuated to supply additional water to the boiler or steam generator 10. By supplying additional water into the boiler or steam generator 10 the impurities in the waste water within the boiler or steam generator 10 are permitted to be discharged while the clean water supplied to the boiler or steam generator 10 is preheated.

A temperature switch 200 would include a temperature sensor located within the boiler or steam generator 10 for determining the temperature inside the boiler or steam generator 10. If the temperature within the boiler or steam generator 10 is above a predetermined temperature, the temperature switch 300 would actuate the on/off switch 120 and turn off the boiler or steam generator 10. The temperature switch 200 is a safety switch to make sure that the boiler or steam generator 10 is turned off if the temperature rises above a predetermined temperature.

For self cleaning purposes an outlet fitting 60 is located at the exact height of the desired water level in the boiler or steam generator 10. This outlet fitting 60 would be regulated by a metering device 20. As illustrated in FIG. 1, the metering device 20 may be a metering valve.

As illustrated in FIG. 2, the metering device 20 would include a capillary tube 201 for restricting the flow of water into the boiler or steam generator 10 that would work together with a pressure regulator 202. The pressure regulator 202 and the capillary tube 201 would supply a predetermine flow of water to the boiler or steam generator 10 when the solenoid 50 is actuated. The amount of regulated water going into the boiler or steam generator 10 would be slightly more than is required for the steam to be generated which would cause the water level to go up to force excess water out of the overflow of outlet 60. If the water level goes down below the outlet of overflow 60, only a small amount of steam would go out and thus the level would be maintained.

Because impurities do not turn into steam, the impurities remain in the water. By slightly over-filling the boiler or steam generator 10 the clean water turns into steam while the dirty water and impurities are flushed through to the outlet 60. Thus, the steam generator 10 is continuously cleaned.

A counter flow heat exchanger 70 cools the discharge water or steam while preheating the incoming water. Thus, all the heat that was generated is preserved while flushing out the dirty impure waste water.

Chemicals can be added to the system and can either be dumped or be gradually dissipated out the overflow 60.

A solenoid valve 80 may be added to the discharge line or overflow 90 to conserve water when the unit is left on for extended periods of time and not being used.

In operation, the steam generator boiler 10 is operated and the metering device 20 in the inlet 30 regulates the flow of water to the boiler or steam generator 10 in parallel with the operation of the heaters 40.

The pressure switch 100 would include a pressure sensor located within the boiler or steam generator 10 for determining the pressure inside the boiler or steam generator 10. When the pressure within the boiler or steam generator 10 rises above approximately two pounds per square inch, the pressure within the boiler or steam generator 10 would actuate the on/off switch 120 and turn off the heaters 40 and turn off the solenoid 50. If the pressure within the boiler or steam generator 10 is lowered to approximately one pound per square inch, the pressure switch 100 would actuate the on/off switch 120 and turn on the heaters 40 and the solenoid 50 would be actuated to supply additional water to the boiler or steam generator 10. The sequence of the turning on and off of the heaters 40 and the water in solenoid 50 would operate in a cycle to make sure that the boiler or steam generator 10 is maintained at a pressure of between approximately one to two pounds per square inch. The supply of additional water into the boiler or steam generator 10 permits the discharge of the impurities in the waste water within the boiler or steam generator 10 while enabling clean water that is supplied to the boiler or steam generator 10 to be preheated.

The temperature switch 200 is operated as a safety switch to make sure that the boiler or steam generator 10 is turned off if the temperature rises above a predetermined temperature.

When the boiler or steam generator 10 is used, the impurities do not turn into steam, the impurities remain in the water. Thus, by slightly over-filling the boiler or steam generator 10 with clean water, the dirty water and impurities are flushed through to the outlet 60. Thus, the boiler or steam generator 10 continuously produces steam while being continuously cleaned.

The counter flow heat exchanger 70 does enable the discharged, impure water or steam to be cooled while preheating the incoming water. The present invention permits all of the heat that was generated to be preserved while flushing out the dirty impure waste water.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A steam generator boiler for generating steam comprising:

a boiler;

a supply conduit for supplying water to said boiler;

a supply valve for controlling the supply of water through the supply conduit;

a heater for supplying heat to said boiler for generating steam;

a discharge conduit for discharging excess impure water from said boiler;

a metering device operatively connected to said supply conduit for regulating the flow of water to the boiler by calculating the amount of water required based on wattage or BTU's generated by the heater;

a pressure switch for operating said boiler, said pressure switch also operating the supply valve on the supply conduit for supplying water to the boiler; and a heat exchanger for receiving discharged heated water from the steam generator and preheating water supplied to the boiler.

2. The steam generator boiler according to claim 1, and further including a valve for controlling the discharge of water from the boiler.

3. The steam generator boiler according to claim 1, wherein the pressure switch will turn off the heater and the supply valve for controlling the supply of water when the pressure in the boiler exceeds a predetermined pressure.

4. The steam generator boiler according to claim 1, wherein the pressure switch will turn on the heater and the supply valve for controlling the supply of water when the pressure in the boiler is below a predetermined pressure.

5. The steam generator boiler according to claim 1, and further including a temperature switch operatively connected to the boiler for turning off the heater and supply valve for controlling the supply of water when the temperature exceeds a predetermined temperature.

6. The steam generator boiler according to claim 1, wherein the metering device includes a capillary tube and a pressure regulator for supply a predetermined quantity of water to the boiler when the supply valve for controlling the supply of water is turned on.

7. A steam generator boiler for generating steam comprising;

a boiler;

a supply conduit for supplying water to said boiler;

a supply valve for controlling the supply of water through the supply conduit;

a heater for supplying heat to said boiler for generating steam;

a discharge conduit for discharging excess impure water from said boiler;

a metering device operatively connected to said supply conduit for regulating the flow of water to the boiler by calculating the amount of water required based on wattage or BTU's generated by the heater;

a thermostat for turning off the heater when the temperature in the boiler exceeds a predetermined temperature, said thermostat also operating the supply valve on the supply conduit for terminating the supply of water to the boiler when the heater is turned off; and a heat exchanger for receiving discharged heated water from the steam generator and preheating water supplied to the boiler.

8. The steam generator boiler according to claim 7, and further including a valve for controlling the discharge of water from the boiler.

9. The steam generator boiler according to claim 7, and further including a pressure switch for turning off the heater and the supply valve for controlling the supply of water when the pressure in the boiler exceeds a predetermined pressure.

10. The steam generator boiler according to claim 7, and further including a pressure switch for turning on the heater and the supply valve for controlling the supply of water when the pressure in the boiler is below a predetermined pressure.

11. The steam generator boiler according to claim 7, wherein the thermostat is operatively connected to a temperature switch operatively connected to the boiler for turning off the heater and supply valve for controlling the supply of water when the temperature exceeds a predetermined temperature.

12. The steam generator boiler according to claim 7, wherein the metering device includes a capillary tube and a pressure regulator for supply a predetermined quantity of water to the boiler when the supply valve for controlling the supply of water is turned on.

13. A steam generator boiler for generating steam comprising;

a boiler;

a heater for supplying heat to said boiler for generating steam;

a controller for controlling the supply of water to the boiler for regulating the flow of water to the boiler by calculating the amount of water required based on wattage or BTU's generated by the heater;

a discharge conduit for discharging excess impure water from said boiler;

a pressure switch for operating said heater and the controller for turning off the heater and terminating the supply of water to the boiler when the pressure exceeds a predetermined pressure;

wherein the controller is a metering device including a capillary tube and a pressure regulator for supply a predetermined quantity of water to the boiler when the supply valve for controlling the supply of water is turned on.

14. The steam generator boiler according to claim 13, and further including a heat exchanger for receiving discharged heated water from the steam generator and preheating water supplied to the boiler.

15. The steam generator boiler according to claim 14, and further including a valve for controlling the discharge of water from the boiler.

16. The steam generator boiler according to claim 13, and further including a temperature switch for turning off the heater and the controller for controlling the supply of water when the pressure in the boiler exceeds a predetermined temperature.

17. The steam generator boiler according to claim 13, and further including a thermostat operatively connected to a temperature switch operatively connected to the boiler for turning off the heater and the controller for controlling the supply of water when the temperature exceeds a perdetermined temperature.

* * * * *